US009657482B2

(12) United States Patent
Ko et al.

(10) Patent No.: US 9,657,482 B2
(45) Date of Patent: May 23, 2017

(54) FLOOR PANEL HAVING ADHESIVE APPLIED SHEET

(71) Applicant: LG HAUSYS, LTD., Seoul (KR)

(72) Inventors: Hae Seung Ko, Anyang-si (KR); Jun Hyuk Kwon, Suwon-si (KR); Sang Sun Park, Cheongju-si (KR)

(73) Assignee: LG Hausys, Ltd., Seoul (KR)

( * ) Notice: Subject to any disclaimer, the term of this patent is extended or adjusted under 35 U.S.C. 154(b) by 31 days.

(21) Appl. No.: 14/380,233

(22) PCT Filed: Mar. 4, 2013

(86) PCT No.: PCT/KR2013/001688
§ 371 (c)(1),
(2) Date: Aug. 21, 2014

(87) PCT Pub. No.: WO2013/129892
PCT Pub. Date: Sep. 6, 2013

(65) Prior Publication Data

US 2015/0044409 A1 Feb. 12, 2015

(30) Foreign Application Priority Data

Mar. 2, 2012 (KR) ..... 10-2012-0021557

(51) Int. Cl.
*E04F 15/02* (2006.01)
*E04C 2/30* (2006.01)
*E04F 15/10* (2006.01)

(52) U.S. Cl.
CPC ..... *E04F 15/02* (2013.01); *E04C 2/30* (2013.01); *E04F 15/02038* (2013.01);
(Continued)

(58) Field of Classification Search
CPC . E04F 15/02038; E04F 15/105; E04F 15/107; E04F 15/02; E04F 15/02155; E04F 2201/0138; E04F 2201/07; E04F 2203/065; E04C 2/30; Y10T 428/1486; Y10T 428/1476; Y10T 428/14; B32B 3/06;
(Continued)

(56) References Cited

U.S. PATENT DOCUMENTS 7,846,522 B2 * 12/2010 Kaminski ..... B32B 5/022 428/141
9,017,785 B2 * 4/2015 Ko ..... B32B 3/06 428/40.1
(Continued)

FOREIGN PATENT DOCUMENTS

CN 101177970 A 5/2008
EP 2581423 A1 * 4/2013 ..... C09J 7/00
WO 2012/026722 A2 3/2012

*Primary Examiner* — Patricia L Nordmeyer
(74) *Attorney, Agent, or Firm* — Dentons US LLP

(57) ABSTRACT

A floor panel having an adhesive applied sheet, including: a tile; an adhesive sheet laminated on the tile, the adhesive sheet having an adhesive applied face exposed in an L-shaped form at the edge of the tile; and an adhesive layer interposed between contact faces of the tile and the adhesive sheet, where the adhesive sheet includes: a sheet made of one of PVC, PLA, PET, PE, and PP; an acryl-based adhesive adhered on one side of the sheet; and a protective film adhered on the adhesive applied face exposed in the L-shaped form.

7 Claims, 2 Drawing Sheets

(52) U.S. Cl.
CPC ..... *E04F 15/105* (2013.01); *E04F 15/107* (2013.01); *E04F 2201/0138* (2013.01); *E04F 2201/07* (2013.01); *E04F 2203/065* (2013.01); *Y10T 428/14* (2015.01); *Y10T 428/1476* (2015.01)

(58) Field of Classification Search
CPC ..... B32B 27/08; B32B 27/12; B32B 27/304; B32B 27/36; B32B 37/182; B32B 7/12; B32B 2250/05; B32B 2250/44; B32B 2255/10; B32B 2262/101; B32B 2264/104
See application file for complete search history.

(56) References Cited

U.S. PATENT DOCUMENTS

2007/0175137 A1* 8/2007 Stone ..... B32B 27/00 52/295
2010/0247834 A1* 9/2010 Balmer ..... E04F 15/107 428/41.8

* cited by examiner

FLOOR PANEL HAVING ADHESIVE APPLIED SHEET

This Application is a 35 U.S.C. §371 National Stage entry of International Application No. PCT/KR2013/001688, filed Mar. 4, 2013, which claims benefit of Korean Application No. 10-2012-0021557, filed Mar. 2, 2012, all of which are hereby incorporated by reference in their entirety for all purposes as if fully set forth herein.

TECHNICAL FIELD

The present invention relates to a floor panel having an adhesive applied sheet, and more particularly, to a floor panel, which has an adhesive applied sheet adhered on one side of the floor panel in the process of manufacturing the interior floor panel so that there is no need to additionally apply adhesives at the time of construction of floor panels to thereby enhance convenience in construction.

BACKGROUND ART

In general, in the case of synthetic resin floor panels used as flooring coverings for building, an adhesive is applied onto the floor finished surface, and then, the synthetic resin floor panels are adhered on the top of the adhesive.

In this instance, an oil type adhesive is generally used, but it consists of volatile materials harmful to the human body. So, such synthetic resin floor panels using the adhesive may have bad effects on environment or people, for instance, they may damage workers' health during construction of the floor panels and users' health after the construction of the floor panels.

Moreover, in order to construct the synthetic resin floor panels, before installation of the synthetic resin floor panels, an adhesive applying process must be carried out. However, the adhesive applying process is carried out complicatedly by manual labor and deteriorates constructability due to an increase of working hours and an increase of manpower required.

DISCLOSURE OF INVENTION

Technical Problem

Accordingly, the present invention has been made in an effort to solve the above-mentioned problems occurring in the prior arts, and it is an object of the present invention to provide a floor panel having an adhesive applied sheet, which can be constructed without carrying out an adhesive applying process because the adhesive applied sheet is adhered on a rear side of the floor panel in the process of manufacturing the floor panel, which is easy to be removed and recycled because an adhesive is not applied to the floor during construction, and which can enhance consumers' satisfaction because it uses environment-friendly materials.

Solution to Problem

To achieve the above objects, the present invention provides a floor panel having an adhesive applied sheet including: a tile; an adhesive sheet laminated on the tile, the adhesive sheet having an adhesive applied face exposed in an L-shaped form at the edge of the tile; and an adhesive layer interposed between contact faces of the tile and the adhesive sheet, wherein the adhesive sheet includes: a sheet made of one of PVC, PLA, PET, PE, and PP; an acryl-based adhesive adhered on one side of the sheet; and a protective film adhered on the adhesive applied face exposed in the L-shaped form.

In this instance, the protective film is made of one of paper, PP, PE, and PET.

Moreover, the tile includes: a G/F layer for dimensional reinforcement; an intermediate layer attached on the G/F layer and being made of PVC or PLA in order to keep upper and lower balance; a printed layer attached on the intermediate layer; a transparent cover layer on the printed layer; a high-strength UV layer laminated on the transparent cover layer; a base layer attached beneath the G/F layer; and a balance layer attached beneath the base layer.

Furthermore, the transparent cover layer is made of PVC or PLA and is 0.1 mm to 0.7 mm thick, the intermediate layer is made of PVC or PLA and is 0.1 mm to 0.7 mm thick, the G/F layer is 0.1 mm to 0.5 mm thick, the base layer is made of PVC or PLA and is 1.0 mm to 2.0 mm thick, and the balance layer is made of PVC or PLA and is 0.1 mm to 0.3 mm thick.

Additionally, the sheet is 0.1 mm to 0.3 mm thick, and the acryl-based adhesive is 10 m to 100 m thick.

In addition, the adhesive layer is formed coating strong instantaneous adhesives.

Advantageous Effects of Invention

According to the present invention, the floor panel having the sheet with an adhesive function on the rear side enables the worker to easily construct the floor panel because the complicated adhesive applying process is omitted, and enhances convenience in construction because it is easily removed if necessary.

Furthermore, the floor panel having the adhesive applied sheet according to the present invention can prevent expansion and contraction of the floor panel according to changes in temperature because the contact faces of the tile and the sheet are firmly adhered together by a medium of the adhesive layer with a strong adhesive force.

MODE FOR THE INVENTION

Figure 1:
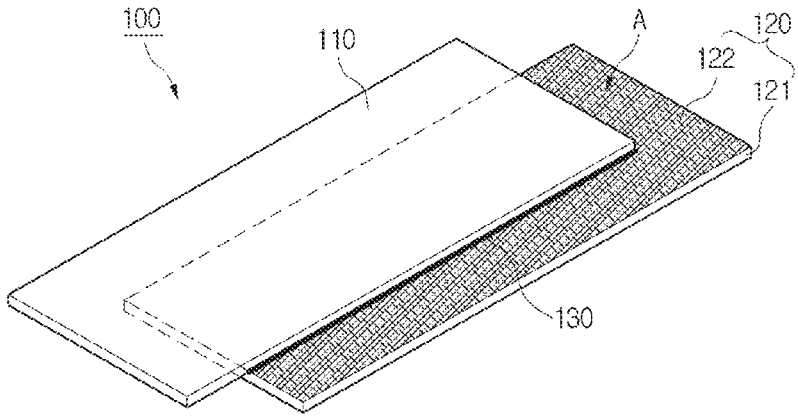
FIG. 1 is a perspective view of a floor panel having an adhesive applied sheet according to the present invention.

Reference will be now made in detail to the preferred embodiment of the present invention with reference to the attached drawings.

In the drawings, the same components have the same reference numerals even though they are illustrated in different figures.

Figure 2:
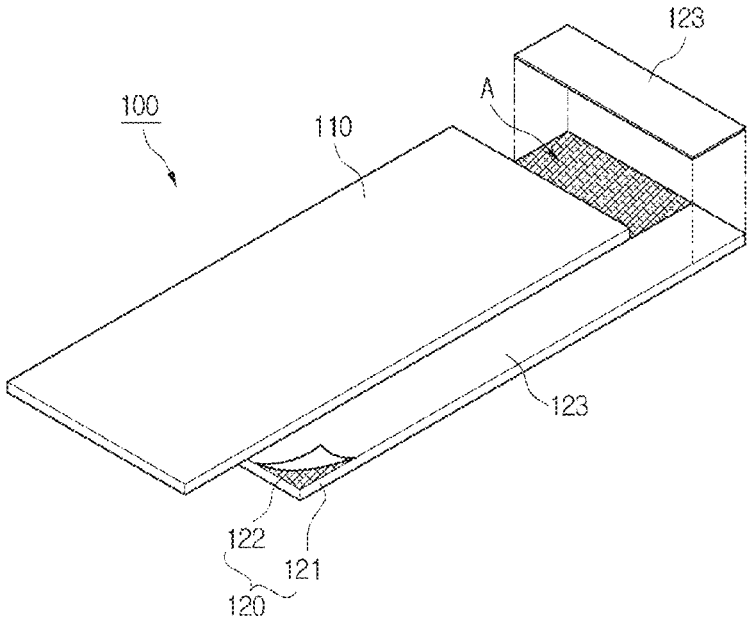
FIG. 2 is an exploded perspective view showing a state where a protective film is adhered on the adhesive applied face exposed in an L-shaped form.
Figure 3:
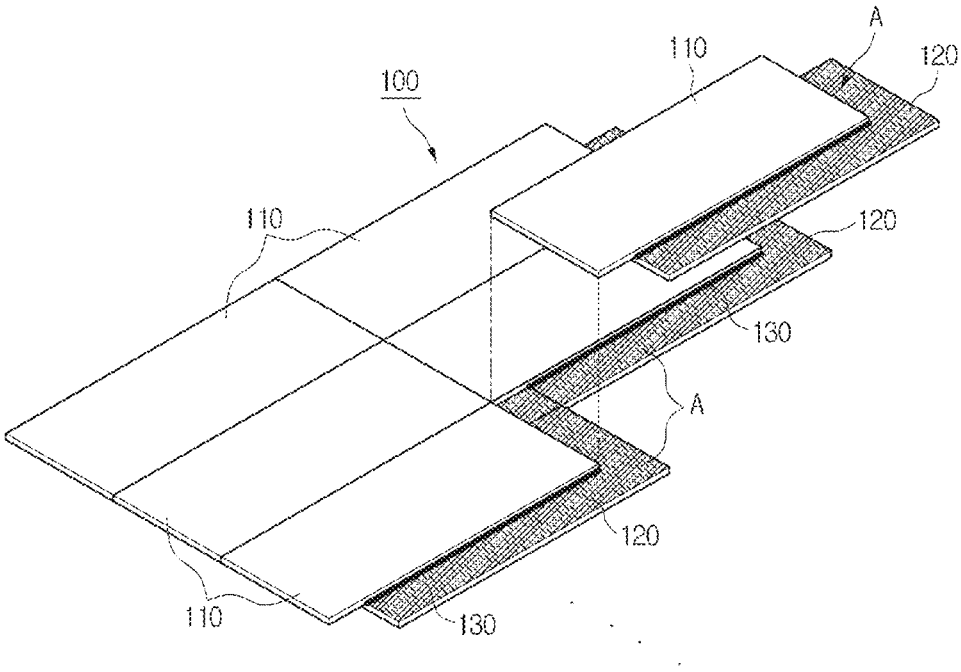
FIG. 3 is a sectional view showing a structure of the floor panel having the adhesive applied sheet according to the present invention.

FIG. 1 is a perspective view of a floor panel having an adhesive applied sheet according to the present invention, FIG. 2 is an exploded perspective view showing a state where a protective film is adhered on the adhesive applied face exposed in an L-shaped form, and FIG. 3 is a sectional view showing a structure of the floor panel having the adhesive applied sheet according to the present invention.

Referring to FIGS. 1 and 2, the floor panel 100 having the adhesive applied sheet according to a preferred embodiment of the present invention includes: a tile 110; an adhesive sheet 120 laminated on the tile 110 and having an adhesive applied face (A) which is exposed in an L-shaped form at the edge of the tile 110; and an adhesive layer 130 interposed between contact faces of the tile 110 and the adhesive sheet 120.

The structure of the floor panel 100 having the adhesive applied sheet according to the present invention will be described in detail as follows.

First, the tile 110 is made of synthetic resins and has an outward appearance with various colors and designs. Here, preferably, the tile 110 includes a plurality of layers laminated in order, for instance, a base layer, an intermediate layer, a printed layer and others located on the base layer in order, and an UV layer laminated on the printed layer. Referring to FIG. 3, the multiple layers of the tile 110 will be described in more detail. The tile 110 includes a high-strength UV layer 111, a transparent cover layer 112, a printed layer 113, an intermediate layer 114, a G/F (Glass fiber) layer 115, a base layer 116, and a balance layer 117 which are laminated from the top.

Now, the size of the tile 110 will be described. The transparent cover layer 112 is made of PVC (Poly Vinyl Chloride) or PLA (Poly Lactic Acid), and is 0.1 mm to 0.7 mm thick. The intermediate layer 114 serves to keep upper and lower balance, and it is preferable that the intermediate layer 114 is made of PVC or PLA and is 0.1 mm to 0.7 mm thick. It is preferable that the G/F layer 115 for dimensional reinforcement of the tile 110 is 0.1 mm to 0.5 mm thick. In the present invention, for dimension stabilization of the resin-based tile, the G/F layer may be used. Additionally, it is preferable that the base layer 116 is made of PVC or PLA, and is 1.0 mm to 2.0 mm thick. The balance layer 117 is also made of PVC or PLA, and is 0.1 mm to 0.3 mm thick.

Now, a manufacturing process of the tile 110 having the above structure will be described. Raw materials containing PVC and DOTP (Dioctyl Terephthalate) plasticizer, calcium carbonate filler, and stabilizer are mixed by a mixer, and then, are kneaded for about 180 seconds by a kneader with steam pressure of 62.0 kgf/cm2. After that, the base layer 116 which is 1.55 mm thick is processed through a roll mixer. The balance layer 117 which is processed in thickness of 0.15 mm is adhered beneath the base layer 116 using a veneer roll, and then, the G/F layer 115, which is a dimension stabilized layer of 0.3 mm in which PVC Sol is impregnated, is continuously laminated on the base layer 116. Moreover, for structural balance, the PVC intermediate layer 114 which is 0.5 mm thick is continuously laminated using the veneer roll, the printed layer 113 for forming an outward appearance design is continuously laminated through the veneer roll, and then, the transparent cover layer 112 which is 0.5 mm thick is laminated using the veneer roll. After that, finally, the surface is treated with ultraviolet rays, and thereby, the tile 110 according to the present invention is finished.

In the manufacturing process of the tile 110 according to the present invention, the floor panel using PVC is described, but the present invention is not limited to the above, and instead of PVC, PLA can be applied.

The adhesive sheet 120 includes a sheet 121 and an acryl-based adhesive 122 adhered on an upper face of the sheet 121. The adhesive part 122 of the adhesive sheet 120 is adhered on the bottom of the tile 110, and in this instance, some of the adhesive 122 is exposed at the edge of one side of the tile 110 in an L-shaped form to thereby form an adhesive applied face (A). In this instance, such a form that the adhesive sheet 120 is partially exposed at the edge of the tile 110 to form the L-shaped exposed portion is called an offset combination. Such an adhesive applied face (A) serves to fix neighboring floor panels 100 together in the process of constructing the floor panels 100. In this instance, the adhesive applied face (A) is easily removable and restickable, so that workers can easily rearrange the floor panels 100 or remove and reuse if necessary in the case that the floor panels 100 which are adjacently arranged side by side are twisted during the construction of the floor panels 100.

Here, preferably, the sheet 121 may be made of one of PVC, PLA, PET, PE, and PP to prevent contraction or expansion of the sheet 121 according to changes in temperature. In this instance, it is preferable that the sheet 121 is 0.1 mm to 0.3 mm thick and the acryl-based adhesive 122 is 10 m to 100 m thick.

Moreover, a protective film 123 is adhered on the adhesive applied face (A) exposed in the L-shaped form. Accordingly, it can prevent that the adhesive applied face (A) is exposed to the air and polluted by moisture or dust before the floor panel 100 is constructed. Such a protective film 123 may be made of one of paper, PP, PE, and PET.

The adhesive layer 130 is interposed between the contact surfaces of the tile 110 and the adhesive sheet 120 to reinforce an adhesive force between the tile 110 and the adhesive sheet 120. In more detail, the floor panel 100 which is constructed through the method that the adhesive applied faces (A) are arranged and adhered together without coating any adhesive agent on the floor surface may have various changes according to changes in temperature in the case of flooring heating, namely, expansion and contraction of the tile 110 and the adhesive sheet 120, a change in adhesive force of the adhesive 122. In this case, the adhesive 122 has a limit in preventing changes in dimension of the tile 110 which is laminated thereon and the adhesive sheet 120 which is laminated beneath the adhesive 122, and finally, and hence, it causes a gap between the constructed floor panels 100.

In order to prevent the changes, the adhesive layer 130 is used to firmly adhere the tile 110 and the adhesive sheet 120 together to thereby firmly hold the upper and lower parts of the floor panel 100, and thereby, it can prevent the gap occurring between the floor panels 100. Here, preferably, the adhesive layer 130 is coated on the upper surface of the adhesive 122 excluding the adhesive applied face (A). In order to obtain a strong adhesive force, it is preferable that the adhesive layer 130 is formed using liquid type strong instantaneous adhesives.

Figure 4:
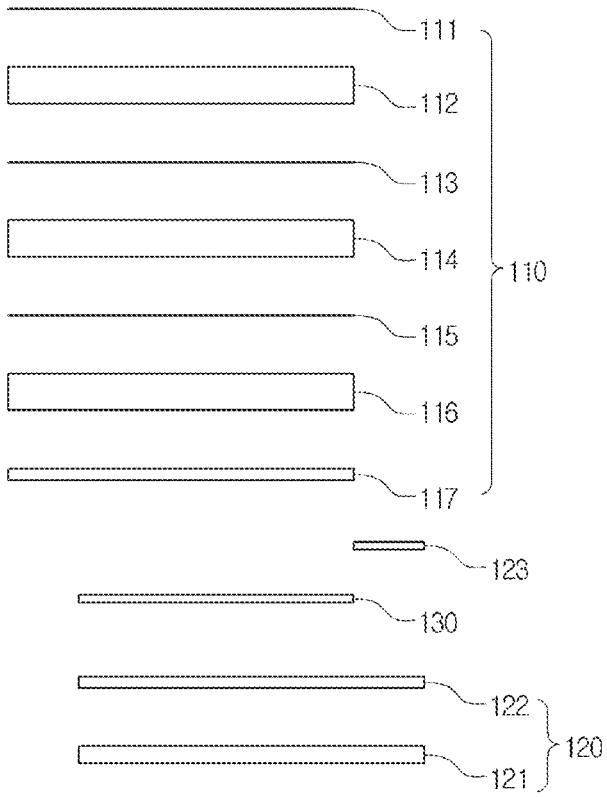
FIG. 4 is a view showing a constructed state of the floor panel having the adhesive applied sheet according to the present invention.

FIG. 4 is a view showing a constructed state of the floor panel having the adhesive applied sheet according to the present invention. As shown in the drawing, the floor panel having the adhesive applied sheet according to the present invention is constructed in such a manner that the bottom of the tile 110 of another floor panel 100 is arranged and adhered side by side on the adhesive applied face (A) exposed in the L-shaped form at the edge of the floor panel 100 without coating additional adhesives on the floor surface. Therefore, the floor panel having the adhesive applied sheet according to the present invention can enhance convenience in removal and recyclability, and increase consumers' satisfaction because it uses environment-friendly materials.

Furthermore, the floor panel having the adhesive applied sheet according to the present invention can prevent expansion and contraction of the tile 110 and the adhesive sheet 120 according to changes in temperature because the contact faces of the tile 110 and the adhesive sheet 120 are adhered together by a medium of the adhesive layer 130 to firmly hold them.

While the present invention has been particularly shown and described with reference to the preferable embodiment thereof, it will be understood by those of ordinary skill in the art that the present invention is not limited to the above embodiment and various changes may be made therein without departing from the technical idea of the present invention.

EXPLANATION OF ESSENTIAL REFERENCE NUMERALS IN DRAWINGS

100: floor panel 110: tile
111: UV layer 112: transparent cover layer
113: printed layer 114: intermediate layer
115: G/F layer 116: base layer
117: balance layer 120: adhesive sheet
121: sheet 122: adhesive
123: protective film 130: adhesive layer

The invention claimed is:

1. A floor panel having an adhesive applied sheet comprising:
- a tile;
- an adhesive sheet laminated on the tile, the adhesive sheet having an adhesive applied face exposed in an L-shaped form at the edge of the tile; and
- an adhesive layer interposed between contact faces of the tile and the adhesive sheet,
- wherein the adhesive sheet comprises:
  - a sheet made of one of polyvinyl chloride (PVC), polylactic acid (PLA), polyethylene terephthalate (PET), polyethylene (PE), and polypropylene (PP);
  - an acryl-based adhesive adhered on one side of the sheet; and
  - a protective film adhered on the adhesive applied face exposed in the L-shaped form, and
- wherein, the adhesive layer is disposed on an upper surface of the adhesive sheet excluding the adhesive applied face, and comprises an instant adhesive, and
- wherein the tile comprises:
  - a glass fiber (G/F) layer for dimensional reinforcement;
  - an intermediate layer attached on the glass fiber layer and being made of polyvinyl chloride (PVC) or polylactic acid (PLA) in order to keep upper and lower balance;
  - a printed layer attached on the intermediate layer;
  - a transparent cover layer on the printed layer;
  - a high-strength UV layer laminated on the transparent cover layer;
  - a base layer attached beneath the glass fiber layer; and
  - a balance layer comprising PVC or PLA attached beneath the base layer.

2. The floor panel according to claim 1, wherein the protective film is made of one of paper, PP, PE, and PET.

3. The floor panel according to claim 2, wherein
- the transparent cover layer is made of PVC or PLA and is 0.1 mm to 0.7 mm thick,
- the intermediate layer is made of PVC or PLA and is 0.1 mm to 0.7 mm thick,
- the G/F layer is 0.1 mm to 0.5 mm thick,
- the base layer is made of PVC or PLA and is 1.0 mm to 2.0 mm thick, and
- the balance layer comprising PVC or PLA is 0.1 mm to 0.3 mm thick.

4. The floor panel according to claim 3, wherein the sheet is 0.1 mm to 0.3 mm thick, and the acryl-based adhesive is 10 μm to 100 μm thick.

5. The floor panel according to claim 1, wherein
- the transparent cover layer is made of PVC or PLA and is 0.1 mm to 0.7 mm thick,
- the intermediate layer is made of PVC or PLA and is 0.1 mm to 0.7 mm thick,
- the G/F layer is 0.1 mm to 0.5 mm thick,
- the base layer is made of PVC or PLA and is 1.0 mm to 2.0 mm thick, and
- the balance layer comprising PVC or PLA is 0.1 mm to 0.3 mm thick.

6. The floor panel according to claim 5, wherein the sheet is 0.1 mm to 0.3 mm thick, and the acryl-based adhesive is 10 μm to 100 μm thick.

7. The floor panel according to claim 1, wherein the sheet is 0.1 mm to 0.3 mm thick, and the acryl-based adhesive is 10 μm to 100 μm thick.

* * * * *